US011612020B2

(12) United States Patent
Yun et al.

(10) Patent No.: US 11,612,020 B2
(45) Date of Patent: Mar. 21, 2023

(54) COOKING APPARATUS AND METHOD FOR CONTROLLING THEREOF

(71) Applicant: Samsung Electronics Co., Ltd., Suwon-si (KR)

(72) Inventors: Changsun Yun, Suwon-si (KR); Hongjoo Kang, Suwon-si (KR); Dongoh Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 678 days.

(21) Appl. No.: 16/450,318

(22) Filed: Jun. 24, 2019

(65) Prior Publication Data

US 2019/0394837 A1 Dec. 26, 2019

(30) Foreign Application Priority Data

Jun. 25, 2018 (KR) ..... 10-2018-0072983

(51) Int. Cl.
*H05B 6/06* (2006.01)
*H05B 6/44* (2006.01)
*H05B 6/12* (2006.01)

(52) U.S. Cl.
CPC ..... *H05B 6/065* (2013.01); *H05B 6/1209* (2013.01); *H05B 6/44* (2013.01)

(58) Field of Classification Search
CPC ..... H05B 6/065; H05B 6/1209; H05B 6/44
USPC ..... 219/662, 661, 622, 624, 625, 626, 627, 219/628, 663, 489, 443.1, 65, 6, 660, 219/665, 666, 667, 668, 669, 448.11
See application file for complete search history.

(56) References Cited

U.S. PATENT DOCUMENTS

| | | | | |
|---|---|---|---|---|
| 9,060,389 | B2 | 6/2015 | Lee et al. | |
| 9,113,503 | B2 | 8/2015 | Arnal Valero et al. | |
| 9,935,561 | B2 | 4/2018 | Ide et al. | |
| 10,004,114 | B2 | 6/2018 | Lee et al. | |
| 10,813,177 | B2 | 10/2020 | Park et al. | |
| 2009/0139980 | A1 | 6/2009 | Acero Acero et al. | |
| 2011/0192835 | A1 | 8/2011 | Lee et al. | |
| 2012/0043312 | A1* | 2/2012 | Lee | H05B 6/062 219/622 |
| 2015/0245418 | A1 | 8/2015 | Lee et al. | |

(Continued)

FOREIGN PATENT DOCUMENTS

| | | | |
|---|---|---|---|
| CN | 101909375 | A | 12/2010 |
| CN | 107801264 | A | 3/2018 |

(Continued)

OTHER PUBLICATIONS

International Search Report dated Oct. 14, 2019, issued in International Patent Application No. PCT/KR2019/007632.

(Continued)

*Primary Examiner* — Quang T Van
(74) *Attorney, Agent, or Firm* — Jefferson IP Law, LLP

(57) ABSTRACT

A cooking apparatus is provided. The cooking apparatus acquires input of a plurality of power supplies of different phases. The cooking apparatus includes a plurality of heating coils including a first heating coil and a second heating coil, a plurality of inverters including a first inverter and a second inverter, and a switching circuit configured to selectively provide power from among a first power or a second power supply to at least one of the first inverter or the second inverter.

10 Claims, 8 Drawing Sheets

(56) References Cited

U.S. PATENT DOCUMENTS

| | | | |
|---|---|---|---|
| 2016/0150597 | A1 | 5/2016 | Yun et al. |
| 2018/0063897 | A1 | 3/2018 | Park et al. |

FOREIGN PATENT DOCUMENTS

| | | | |
|---|---|---|---|
| DE | 10 2012 201 237 | A1 | 8/2012 |
| DE | 10 2012 220 324 | A1 | 6/2013 |
| EP | 2 380 399 | B1 | 10/2012 |
| EP | 2 888 925 | | 3/2014 |
| ES | 2 441 647 | A2 | 2/2014 |
| JP | 4301083 | B2 | 7/2009 |
| JP | 2014-017272 | A | 1/2014 |
| KR | 10-0740336 | B | 7/2007 |
| KR | 10-2011-0092891 | A | 8/2011 |
| KR | 10-2016-0006308 | A | 1/2016 |
| WO | 2014/033580 | A1 | 3/2014 |

OTHER PUBLICATIONS

European Search Report dated Apr. 19, 2021, issued in European Application No. 19826298.2.
Chinese Office Action dated Jul. 29, 2022, issued in Chinese Patent Application No. 201980043326.3.
Korean Office Action dated Oct. 19, 2022, issued in Korean Patent Application No. 10-2018-0072983.

* cited by examiner

COOKING APPARATUS AND METHOD FOR CONTROLLING THEREOF

CROSS-REFERENCE TO RELATED APPLICATION(S)

This application is based on and claims priority under 35 U.S.C. § 119(a) of a Korean patent application number 10-2018-0072983, filed on Jun. 25, 2018, in the Korean Intellectual Property Office, the disclosure of which is incorporated by reference herein in its entirety.

BACKGROUND

1. Field

The disclosure relates to a cooking apparatus and a method for controlling thereof. More particularly, the disclosure relates to a cooking apparatus which is capable of selectively providing a plurality of power of different phases to a heating coil, and a method for controlling thereof.

2. Description of Related Art

A cooking apparatus is a device used for cooking food, and can be heated using electromagnetic signals (e.g., microwave ovens), conduction, and induction. In recent years, an induction cooking apparatus has been used instead of a gas apparatus.

Meanwhile, an induction cooking apparatus may be implemented to include a plurality of burners to satisfy user needs to cook various foods at once. However, a maximum output that can be implemented by a power input to a cooking apparatus is limited and thus, when a plurality of burners are simultaneously used, there is a problem that the cooking performance is deteriorated due to limited power output.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cooking apparatus which is capable of selectively providing a plurality of power supplies of different phases to a heating coil, and a method for controlling thereof.

Additional aspects will be set forth in part in the description which follows and, in part, will be apparent from the description, or may be learned by practice of the presented embodiments.

In accordance with an aspect of the disclosure, a cooking apparatus acquiring input of a plurality of power supplies of different phases is provided. The cooking apparatus includes a plurality of heating coils, a plurality of inverters configured to individually provide a driving power supply to each of the plurality of heating coils, and a switching circuit configured to selectively provide a first power supply or a second power supply from among a plurality of power supplies to at least one inverter from among the plurality of inverters.

In accordance with another aspect of the disclosure, a method for controlling of a cooking apparatus acquiring input of a plurality of power supplies of different phases is provided. The method for controlling includes identifying a power supply to be provided to a plurality of inverters individually providing a driving power supply to each of a plurality of heating coils, providing the identified power supply to each of the plurality of inverters, and generating a driving power supply to each of the plurality of inverters, and providing the generated driving power supply to each of the plurality of heating coils.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In this specification, the terms "comprise", "include", "have", and the like are intended to specify that there are stated features, numbers, steps, operations, elements, parts or combinations thereof, and should not be construed to preclude the presence or addition of one or more other features, integers, steps, operations, elements, parts, or combinations.

Hereinafter, the disclosure will be described in detail with reference to the accompanying drawings.

As used herein, the term "cooking apparatus" refers to an apparatus that heats, reheats, or cools food using a heat source such as gas, electricity, or steam. This cooking apparatus may include, for example, a gas range, a microwave oven, an oven, a toaster, a coffee machine, a grill, or an induction cooking apparatus.

Figure 1:
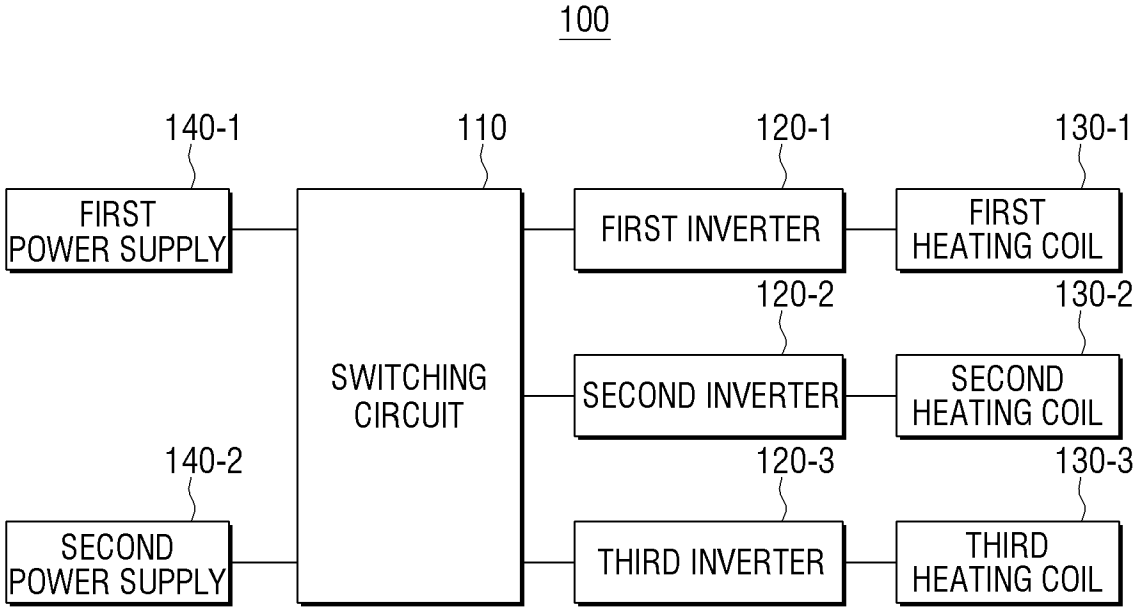
FIG. 1 is a block diagram illustrating a configuration of a cooking apparatus according to an embodiment of the disclosure.

FIG. 1 is a block diagram illustrating a configuration of a cooking apparatus according to an embodiment of the disclosure.

Referring to FIG. 1, a cooking apparatus 100 may include a switching circuit 110, a plurality of inverters 120-1, 120-2 and 120-3, a plurality of heating coils 130-1, 130-2 and 130-3, and a plurality of power supplies 140-1 and 140-2.

The cooking apparatus 100 may be connected to power source having different phases. For example, the cooking apparatus 100 may acquire a power supply via a Y-line alternating current power supply including a voltage line L and a neutral line N, and a plurality of power supplies may include a first power supply and a second power supply. For example, a first power including a 0° phase of a three-phase power supply and a second power including a phase of 120° or 240° of a three-phase power supply may be included.

Here, a voltage line L denotes a line with a unique phase and voltage value, and a neutral line N denotes a line connected to a neutral point where each phase is commonly connected.

The switching circuit 110 may selectively provide power from a plurality of power supplies to the plurality of inverters 120-1, 120-2 and 120-3, respectively. For example, the switching circuit 110 may be disposed between the plurality of power supplies 140-1 and 140-2 and the plurality of inverters 120-1, 120-2 and 120-3, and selectively connect a power supply to the respective inverters.

For example, when it is identified that the first inverter 120-1 and the second inverter 120-2 are connected to the first power supply 140-1 and that the third inverter 120-3 is connected to the second power supply 140-2, the switching circuit 110 may provide power from the first power supply 140-1 to the first inverter 120-1 and the second inverter 120-2, and provide power from the second power supply 140-2 to the third inverter 120-3.

The switching circuit 110 may be disposed on a single substrate along with the plurality of inverters 120-1, 120-2 and 120-3. In addition, the switching circuit 110 may be, when each of the plurality of inverters 120-1, 120-2 and 120-3 are spaced apart from each other on a plurality of first substrates, disposed on a separate second substrate which is spaced apart from the plurality of first substrates. When the cooking apparatus 100 is designed, such a separation structure may flexibly cope with both a case of using the switching circuit 110 and a case of not using the switching circuit 110.

The plurality of inverters 120-1, 120-2 and 120-3 may individually provide a driving power to each of the plurality of heating coils 130-1, 130-2 and 130-3. For example, each of the plurality of inverters may receive a power supply input and provide a driving power corresponding to an output level to the respective heating coils based on a user input.

For example, the first inverter 120-1 may provide a first driving power corresponding to an output level with respect to the first heating coil 130-1, and provide the provided first driving power to the first heating coil 130-1. In addition, the second inverter 120-2 may provide a second driving power corresponding to an output level with respect to the second heating coil 130-2, and provide the second driving power to the second heating coil 130-2.

In addition, the third inverter 120-3 may provide a third driving power corresponding to an output level with respect to the third heating coil 130-3.

The plurality of heating coils 130-1, 130-2 and 130-3 may perform a heating operation based on the driving power. Such a heating coil may be a heating element (i.e., a resistive heating coil that conducts heat), an induction heating coil, or the like. For example, when the heating coil is a resistive heating element, heat may be directly radiated based on a driving power. When the heating coil is an induction heating coil, a cooking container on a burner may be heated using an induction current.

Here, in a cooking apparatus using an induction heating coil, when an alternating current is provided to the induction heating coil, a magnetic field may be induced. In this case, the induced magnetic field may pass into a bottom surface of the cooking container, an eddy current, which is a rotating current, may be generated on the bottom surface, and due to the generated eddy current, the bottom surface of the cooking container may be heated.

In FIG. 1, two power supplies are input to the cooking apparatus 100. However, three or more power supplies may be input.

Referring to FIG. 1, three inverters and three heating coils are included. However, in an example implementation, the cooking apparatus 100 may include only two inverters and two heating coils, and may include four or more inverters and four or more heating coils. In addition, in the example described above, the number of inverters and the number of heating coils are the same. However, in an example implementation, one inverter may provide a driving current to a plurality of heating coils.

Meanwhile, although the above illustrates and describes only the brief configuration of the cooking apparatus 100, various elements may be additionally included as described below with reference to FIG. 2.

Figure 2:
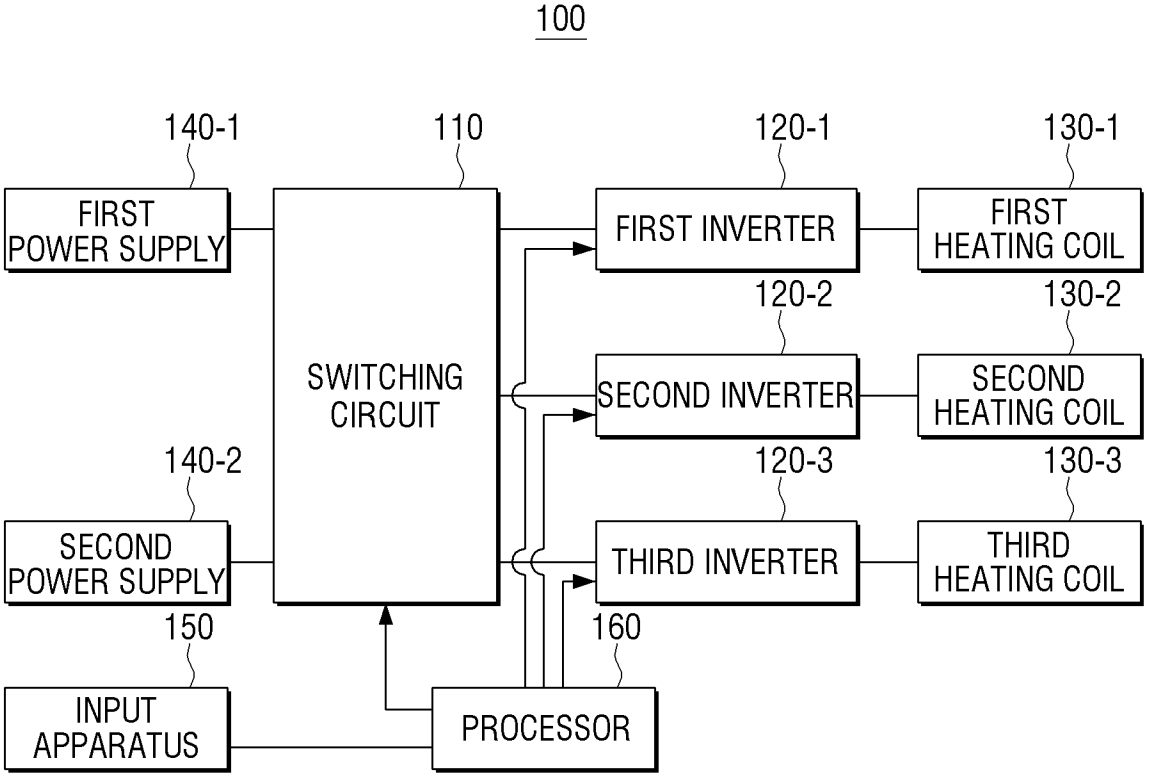
FIG. 2 is a block diagram illustrating a configuration of a cooking apparatus according to an embodiment of the disclosure.

FIG. 2 is a block diagram illustrating a configuration of a cooking apparatus according to an embodiment of the disclosure.

Referring to FIG. 2, a cooking apparatus 100 may include a switching circuit 110, a plurality of inverters 120-1, 120-2 and 120-3, a plurality of heating coils 130-1, 130-2 and 130-3, a plurality of power supplies 140-1 and 140-2, an input apparatus 150, and a processor 160.

The operations of the switching circuit 110, the plurality of inverters 120-1, 120-2 and 120-3, the plurality of heating coils 130-1, 130-2 and 130-3 and the plurality of power supplies 140-1 and 140-2 have been described above in connection with the operations of FIG. 1, and thus detailed descriptions thereof are omitted.

The input apparatus 150 may acquire, from the user, a command to generate heat from one of the plurality of heating coils 130-1, 130-2 and 130-3. Here, the command controls a heating coil to perform a turn-on/turn-off operation (i.e. pulse width modulation), or to select an output level and control a heating coil to be heated to the corresponding heating level. Such an output level may be in such a form that a directly corresponding value (for example, 1, 2, 3 or 4) is input or that a relative change value (for example, +1/−1) is input.

This input apparatus 150 may be implemented as a plurality of physical buttons or switches, etc., and may be implemented as a touch screen capable of simultaneously performing a display function displaying an operation state, etc.

The processor 160 may control each element in the cooking apparatus. For example, the processor 160 may, when a command for the respective heating coils is input through the input apparatus 150, control the switching circuit and the plurality of inverters so that a heating coil corresponding the command is operated.

For example, the processor 160 may control the plurality of inverters 120-1, 120-2 and 120-3 to supply a driving power based on the command provided to each of the plurality of heating coils 130-1, 130-2 and 130-3.

For example, the processor 160 may, when a command to request a heat amount of level "2" with respect to the first heating coil 130-1 is input, control the first inverter 120-1 to provide a first driving power corresponding to "2" to the first heating coil 130-1, and when a user command to request a heat amount of level "3" with respect to the second heating coil 130-2 is input, control the second inverter 120-2 to provide a second driving power corresponding to the second heating coil 130-2.

In addition, the processor 160 may, when a command to request heat amount of level "1" with respect to the third heating coil 130-1 is input, control the third inverter 120-3 to provide a third driving power corresponding to "1" to the third heating coil 130-3.

Meanwhile, the processor 160 may, before controlling the switching circuit 110 to supply power to the plurality of inverters 120-1, 120-2 and 120-3, identify a power supply to provide power to the plurality of inverters 120-1, 120-2 and 120-3 from among the plurality of power supplies 140-1 and 140-2.

For example, the processor 160 may calculate a power consumption of each of the plurality of heating coils 130-1, 130-2 and 130-3, and based on the power consumption, identify a power supply to be provided to the plurality of inverters 120-1, 120-2 and 120-3 from among the first power supply 140-1 or the second power supply 140-2.

For example, the processor 160 may, when a power consumption of the first heating coil 130-1 is 3 kW, a power consumption of the second heating coil 130-2 is 1.2 kW, and a power consumption of the third heating coil 130-3 is 0.8 kW, identify that the first power supply 140-1 is provided to the first inverter 120-1 and that the second power supply 140-2 is provided to both the second inverter 120-2 and the third inverter 120-3.

In addition, when a power consumption of the first heating coil 130-1 is 1 kW, a power consumption of the second heating coil 130-2 and the third heating coil 130-3 is 0 kW, and a command with respect to the second heating coil 130-2 is input to increase the power consumption of the second heating coil 130-2 to 1 kW, the processor 160 may identify that the remaining power other than the power supplied to the first inverter 120-1 is supplied to the second inverter 120-2.

The processor 160 may compare a power consumed by the first heating coil 130-1 with a power consumed by the third heating coil 130-3 and identify which heating coil uses less power, and identify that a power supplied to an inverter corresponding to the corresponding heating coil is supplied to the second inverter 120-2 corresponding to the second heating coil 130-2.

For example, when a power consumption of the first heating coil 130-1 is 230 V×13 A=2990 W and a power consumption of the third heating coil 130-3 is 230 V×3 A=690 W, the processor 160 may identify that the second power supply 140-2 to supply power to the third heating coil 130-3, which is consuming less power (690 W) than is provided to the second inverter 120-2.

In contrast, when a power consumption of the first heating coil 130-1 is 230 V×3 A=690 W and a power consumption of the third heating coil 130-3 is 230 V×13 A=2990 W, the processor 160 may identify that the first power supply 140-1 to supply power to the first heating coil 130-1, which is consuming less power (690 W) than is provided to the second inverter 120-2.

Meanwhile, the processor 160 may, when a command of the first heating coil 130-1 or the third heating coil 130-3 is changed and a heating coil consuming less power is changed, identify that a power supply to provide power to an inverter corresponding to the changed heating coil is provided to the second inverter 120-2.

For example, when a power consumption of the first heating coil 130-1 is 230 V×3 A=690 W and a power consumption of the third heating coil 130-3 is 230 V×13 A=2990 W, but a command with respect to the first heating coil 130-1 is changed and the power consumption is increased to 230 V×15 A=3450 W, the processor 160 may identify that the second power supply 140-2 to supply the power to the third heating coil 130-3, which is consuming less power (2990 W) than is supplied to the second inverter 120-2.

That is, as described above, the processor 160 may, with respect to a command for the respective heating coils, rather than providing a fixed power supply to the inverters respectively corresponding to the heating coils and controlling a driving power supply corresponding to the use command to be supplied, identify that a plurality of power supplies are selectively provided to the respective inverters based on the command for the respective heating coils and a power consumption so that a required driving power is fully provided to each heating coil.

The processor 160 may, when a power to be provided to the plurality of inverters 120-1, 120-2 and 120-3 is identified as described above, control the switching circuit 110 so that a power is provided to the plurality of inverters 120-1, 120-2 and 120-3 as identified.

For example, when the processor 160 identifies that the first power supply 140-1 is provided to the first inverter 120-1 and the second inverter 120-2 and that the second power supply 140-2 is provided to the third inverter 120-3, the switching circuit 110 may be controlled to provide the first power supply 140-1 to the first inverter 120-1 and the second inverter 120-2, and to provide the second power supply 140-2 to the third inverter 120-3.

The processor 160 may, when the heating coil consuming less power described above is changed and a power to be provided to the second inverter 120-2 changes, control the switching circuit 110 to disconnect a previous power supply provided to the second inverter 120-2, and then to connect a power supply to the second inverter 120-2.

For example, the processor 160 may, when a power supply provided to the second inverter 120-2 is changed from the first power supply 140-1 to the second power supply 140-2, control the switching circuit 110 to disconnect the first power supply 140-1, and then to connect the second power supply 140-2 to the second inverter 120-2.

In addition, the processor 160 may control the switching circuit 110 to disconnect a previous power supply provided to the second inverter 120-2, and then, after a preset time elapses, to connect a power supply to the second inverter 120-2.

Here, a preset time may correspond to a discharge time of a capacitor within an apparatus due to a switching operation, which may be identified based on experimentation.

For example, the processor 160 may control the switching circuit 110 disconnect the first power supply 140-1 from the second inverter 120-2, and after a time of approximately 15 ms elapses, connect the second power supply 140-2 to the second inverter 120-2.

In FIG. 2, two power supplies are input. However, in an example implementation, all three power supplies may be input and in this case, the processor 160 may identify that the three power supplies are dynamically provided to the respective inverters.

Referring to FIGS. 1 and 2, only general functions of the cooking apparatus 100 are described. However, in addition to the elements described above, the cooking apparatus 100 may further include a communication apparatus capable of being connected to a network via a wire or wirelessly according to a function supported by the cooking apparatus 100, and communicating with an external apparatus and the server, a memory capable of storing data and programs necessary for controlling the cooking apparatus 100, and the like.

In the related art, each heating coil uses a fixed power supply and thus, it is difficult to provide power supply efficiently when a plurality of burners are simultaneously used. For example, when the first heating coil 130-1 and the second heating coil 130-2 are statically connected to the first power supply 140-1 and that the third heating coil 130-3 is statically connected to the second power supply 140-2, there is a problem in that only the first power supply 140-1 is used when only the first heating coil 130-1 and the second heating coil 130-2 are simultaneously operated. In this example, if a strong output is required for simultaneous operation, that the second power supply 140-2 cannot be used even though the second power supply 140-2 is present. Thus, the power supply cannot be efficiently used.

However, as described above, in the disclosure, the processor 160 may control the switching circuit 110 to selectively provide a power supply or to change a power supply to be provided, so that the power supply may be dynamically allocated. Thus, there is an advantageous effect that the performance of a cooking function can be enhanced even if a plurality of burners are simultaneously used.

Figure 3:
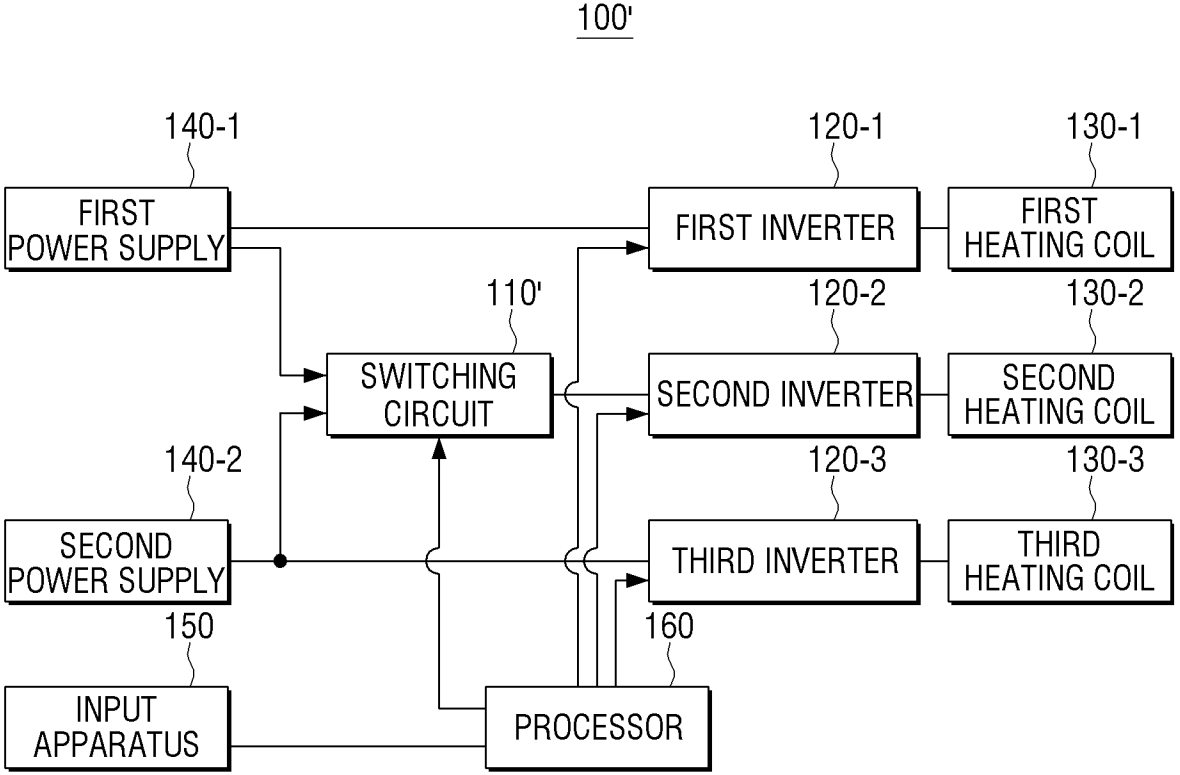
FIG. 3 is a block diagram illustrating a configuration of a cooking apparatus according to an embodiment of the disclosure.

FIG. 3 is a block diagram illustrating a configuration of a cooking apparatus according to an embodiment of the disclosure.

Referring to FIG. 3, a cooking apparatus 100' is provided to explain an example in which the first inverter 120-1 and the third inverter 120-3 fixedly use (i.e., statically connected to) the first power supply 140-1 and the second power supply 140-2, respectively, and the second inverter 120-2 selectively uses the first power supply 140-1 or the second power supply 140-2.

The cooking apparatus 100' may include a switching circuit 110', a plurality of inverters 120-1, 120-2 and 120-3, a plurality of heating coils 130-1, 130-2 and 130-3, a plurality of power supplies 140-1 and 140-2, an input apparatus 150, and a processor 160.

Operations of the plurality of inverters 120-1, 120-2 and 120-3, the plurality of heating coils 130-1, 130-2 and 130-3, the plurality of power supplies 140-1 and 140-2 and the input apparatus 150 have been described above in connection with the operations of FIG. 1, and thus detailed descriptions thereof are omitted.

The switching circuit 110' may selectively connect the first power supply 140-1 or the second power supply 140-2 to the second inverter 120-2. For example, the switching circuit 110' may selectively connect the first power supply 140-1 or the second power supply 140-2 to the second inverter 120-2 under the control of the processor 160. To this end, the switching circuit 110' may include two switches and may provide a power supply through an open and close operation of a switching switch.

For example, the switching circuit 110' may, when a switching circuit between the first power supply 140-1 and the second inverter 120-2 is closed and a switching circuit between the second power supply 140-2 and the second inverter 120-2 is opened, connect the first power supply 140-1 to the second inverter 120-2, and when the switching circuit between the second power supply 140-2 and the second inverter 120-2 is closed and the switching circuit between the first power supply 140-1 and the second inverter 140-2 is opened, connect the second power supply 140-2 to the second inverter 120-2.

The switching circuit 110' may be disposed on one printed circuit substrate along with the second inverter 120-2. In addition, the switching circuit 110' may be disposed on a second substrate, which is spaced apart from a first substrate. Such a separation structure may flexibly cope with both a case of using the switching circuit 110' and a case of not using the switching circuit 110' when the cooking apparatus 100' is designed.

The processor 160 may identify a power supply to be connected to the second inverter 120-2 because the first inverter 120-1 and the third inverter 120-3 are fixedly connected to the first power supply 140-1 and the second power supply 140-2.

However, in this case, the processor 160 may identify a power supply to be connected to the second inverter 120-2 based on all operation states of the respective heating coils. That is, the processor 160 may identify a power supply to be connected to the second inverter 120-2 based on a power consumption of the plurality of heating coils 130-1, 130-2 and 130-3, an input command, etc.

For example, the processor 160 may calculate a power consumption of each of the plurality of heating coils 130-1, 130-2 and 130-3, and based on the power consumption, identify a power supply to be connected to the plurality of inverters 120-1, 120-2 and 120-3 from among the first power supply 140-1 or the second power supply 140-2.

For example, when a power consumption of the first heating coil 130-1 is 3 kW and a power consumption of the third heating coil 130-3 is 1.2 kW, the processor 160 may identify that the second power supply 140-2 is connected to the second inverter 120-2.

In contrast, when a power consumption of the first heating coil 130-1 is 1.2 kW and a power consumption of the third heating coil 130-3 is 3 kW, the processor 160 may identify that the first power supply 140-1 is connected to the second inverter 120-2.

The example described above may correspond to a case in which the processor 160 compares a power consumed by the first heating coil 130-1 with a power consumed by the third heating coil 130-3 and identifies which heating coil uses less power, and identifies that a power supplied to an inverter corresponding to the corresponding heating coil is supplied to the second inverter 120-2 corresponding to the second heating coil 130-2.

Meanwhile, while the first heating coil 130-1 and the third heating coil 130-3 are not operated and a power consumption is 0 kW, when a command for driving the second heating coil 130-2 is input, no power consumption is available to identify the power source. Thus, the processor 160 may identify that the first power supply 140-1 or the second power supply 140-2 is used according to a preset default value.

Meanwhile, when a use command of the first heating coil 130-1 or the third heating coil 130-3 is changed and a heating coil consuming less power is changed, the processor 160 may identify that a power supply connected to an inverter corresponding to the changed heating coil is supplied to the second inverter 120-2.

For example, when a power consumption of the first heating coil 130-1 is 230 V×3 A=690 W and a power consumption of the third heating coil 130-3 is 230 V×13 A=2990 W, but a command with respect to the first heating coil 130-1 is changed and the power consumption is increased to 230 V×15 A=3450 W, the processor 160 may identify that the second power supply 140-2 supplies the power to the third heating coil 130-3, which is consuming less power (2990 W) than is supplied to the second inverter 120-2.

The processor 160 may, when a power supply to be connected to the second inverter 120-2 is identified as described above, control the switching circuit 110' so that the power supply is connected to the second inverter 120-2. For example, when it is identified that the first power supply 140-1 is connected to and supplies power to the second inverter 120-2, the processor 160 may, control the switching circuit 110' to provide power from the first power supply 140-1 to the second inverter 120-2.

In addition, when the heating coil that is consuming less power described above and changes and a power supply to be connected to the second inverter 120-2 changes, the processor 160 may control the switching circuit 110' to turn off a previous power supply provided to the second inverter 120-2, and then to provide a power supply provided to an inverter corresponding to the changed heating coil to the second inverter 120-2.

For example, when a power supply provided to the second inverter 120-2 changes from the first power supply 140-1 to the second power supply 140-2, the processor 160 may control the switching circuit 110' to disconnect from the first power supply 140-1, and then connect the second power supply 140-2 to the second inverter 120-2.

In addition, the processor 160 may control the switching circuit 110' to disconnect a previous power supply from the second inverter 120-2, and then, after a preset time elapses, connect a power supply to an inverter corresponding to the changed heating coil to the second inverter 120-2.

Here, a preset time may correspond to a discharge time of a capacitor within an apparatus due to a switching operation, which may be identified based on experimentation.

For example, the processor 160 may control the switching circuit 110' to disconnect the first power supply 140-1 from the second inverter 120-2, and after a time of approximately 15 ms elapses, to connect the second power supply 140-2 to the second inverter 120-2.

In FIG. 3, two inverters acquire input of a fixed power supply. However, in an example implementation, a single inverter may acquire input of a fixed power supply.

Figure 4:
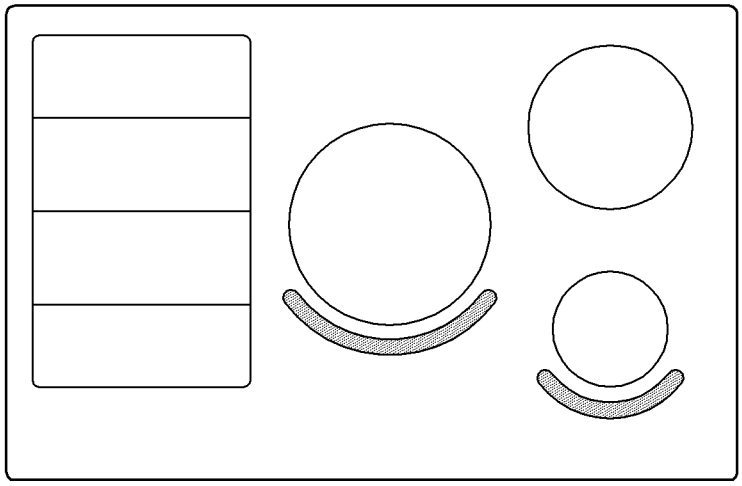
FIG. 4 is a diagram illustrating an example cooking apparatus including a plurality of burners according to an embodiment of the disclosure.

FIG. 4 is a diagram illustrating an example cooking apparatus including a plurality of burners according to an embodiment of the disclosure.

Referring to FIG. 4, the cooking apparatus 100' may include three circular burners and a flexible burner including four areas.

In the circular burner, when a command is input from the user, a heating operation may be performed for the entire area of the circular burner. However, for the flexible burner, when a command is input from the user, a heating operation is performed only on an area of the flexible burner where a cooking container is seated.

For example, when a cooking container is seated on three areas of the flexible burner, a heating operation is performed only on the three areas where the cooking container is located.

The respective circular burners and the respective areas of the flexible burner of the cooking apparatus 100' may include one heating coil. In addition, the cooking apparatus 100' may include an inverter providing a driving power to a heating coil of the respective circular burners, and an inverter providing a driving power to two heating coils of the flexible burner. An explanation of the heating coil will be discussed below with reference to FIG. 5.

Accordingly, the cooking apparatus 100' may include three inverters corresponding to the three circular burners, and two inverters corresponding to the flexible burner, and thus, a total of five inverters. In this case, when the plurality of power supplies 140-1 and 140-2 are input to the cooking apparatus 100', it is necessary to provide a power supply to the five inverters with a total power of 7360 W (230 V×16 A×2=7360 W).

Accordingly, it is necessary to implement an operation demanded by the user with a limited power and thus, the power supply must be efficiently used.

Figure 5:
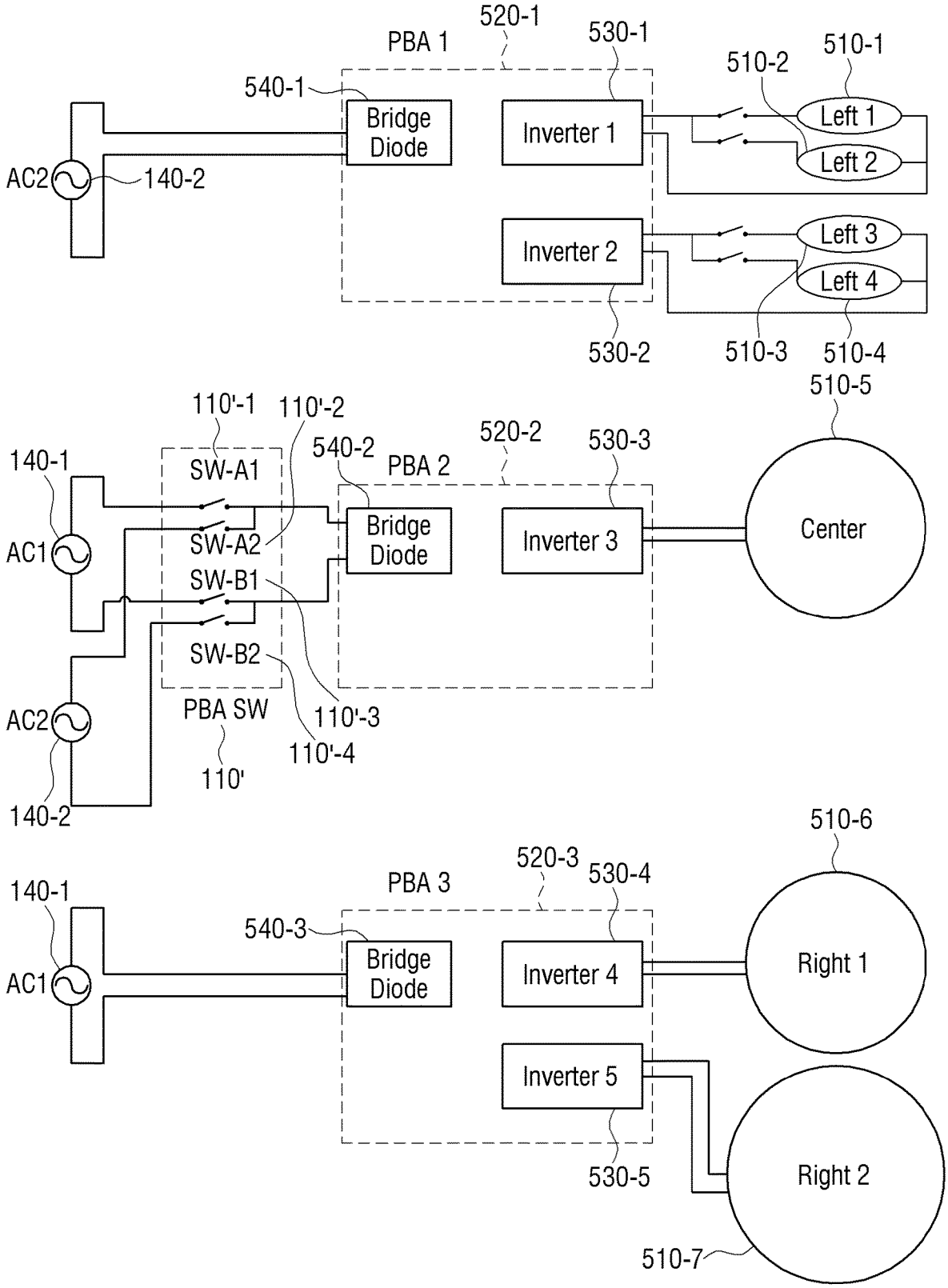
FIG. 5 is a circuit diagram of the example cooking apparatus in FIG. 4 according to an embodiment of the disclosure.

FIG. 5 is a circuit diagram of the example cooking apparatus in FIG. 4 according to an embodiment of the disclosure.

Referring to FIG. 5, the cooking apparatus 100' may include three printed circuit boards (PBAs) 520-1, 520-2 and 520-3, a plurality of power supplies 140-1 and 140-2, and a switching circuit 110'.

The respective PBAs 520-1, 520-2 and 520-3 may include a bridge diode 540-1, 540-2 and 540-3 to rectify an input power source (i.e., convert alternating current to direct current), and inverters 510-1, 510-2, 510-3, 510-4 and 510-5. The PBA 1 520-1 may include a first inverter 530-1 and a second inverter 530-2. The PBA 2 520-2 may include a third inverter 530-3. The PBA 3 520-3 may include a fourth inverter 530-4 and a fifth inverter 530-5.

The first inverter 530-1 may provide a driving power to two heating coils 510-1 and 510-2, the second inverter 530-2 may provide a driving power to two heating coils 510-3 and 510-4, the third inverter 530-3 may provide a driving power to one heating coil 510-5, the fourth inverter 530-4 may provide a driving power to one heating coil 510-6, and the fifth inverter 530-5 may provide a driving power to one heating coil 510-7.

The PBA 1 520-1 may acquire a fixed power supply from the second power supply 140-2. The PBA 3 520-3 may acquire a fixed power supply from the first power supply 140-1. PBA 2 520-2 may selectively acquire a power supply from the first power supply 140-1 or the second power supply 140-2 via the switching circuit 110'.

Accordingly, the respective inverters 530-1, 530-2, 530-3, 530-4 and 530-5 may provide a driving power to a corresponding heating coil by using a power supply provided to a PBA.

The switching circuit 110' may include switches 110'-1 and 110'-2, which are disposed between a voltage line L of the plurality of power supplies 140-1 and 140-2 and one terminal of the PBA 2 520-2. In addition, the switching circuit 110' may include switches 110'-3 and 110'-4, which are disposed between a neutral line N of the plurality of power supplies 140-1 and 140-2 and one terminal of the PBA 2 520-2.

The switching circuit 110' may perform a switching operation using the switches 110'-1 and 110'-2 connected to the voltage line L and the switches 110'-3 and 110'-4 connected to the neutral line N.

For example, when the switches 110'-1 and 110'-3 connected to the voltage line L and center line N of the first power supply 140-1 are closed and the switches 110'-2 and 110'-4 connected to the voltage line L and center line N of the second power supply 140-2 are opened, the first power supply 140-1 may be connected to the PBA 2 520-2. When the switches 110'-1 and 110'-3 are opened and the switches 110'-2 and 110'-4 are closed, the second power supply 140-2 may be connected to the PBA 2 520-2.

In addition, the switching circuit 110' may, rather than including the switches 110'-3 and 110'-4 in the neutral line N, connect one terminal of the PBA 2 520-2 to the neutral line N, and perform a switching operation using the switches 110'-1 and 110'-2.

For example, in a case that the switch 110'-1 is closed and the switch 110'-2 is opened, the first power supply 140-1 may be connected to the PBA 2 520-2. When the switch 110'-1 is opened and the switch 110'-2 is closed, the second power supply 140-2 may be connected to the PBA 2 520-2.

The respective PBAs 520-1, 520-2 and 520-3 may include a rectifier circuit to rectify a power input to the respective PBAs, a smoothing circuit to substantially convert the rectified power supply to a direct current, and an inverter providing a driving power of a preset frequency using the direct current. In this example, the rectifier circuit may include bridge diodes 540-1, 540-2 and 540-3, and the respective bridge diodes 540-1, 540-2 and 540-3 may correspond to a bridge diode of a bidirectional relay type.

The switching circuit 110' is a first substrate including the third inverter 530-3, which is disposed on a separate second substrate and spaced apart from the PBA 2 520-2. However, the switching circuit 110' is combined into the PBA 2 520-2.

Meanwhile, a structure as in the switching circuit 110' of FIG. 5 may flexibly cope with both a case of using the switching circuit 110' and a case of not using the switching circuit 110' when the cooking apparatus 100' is designed.

Figure 6:
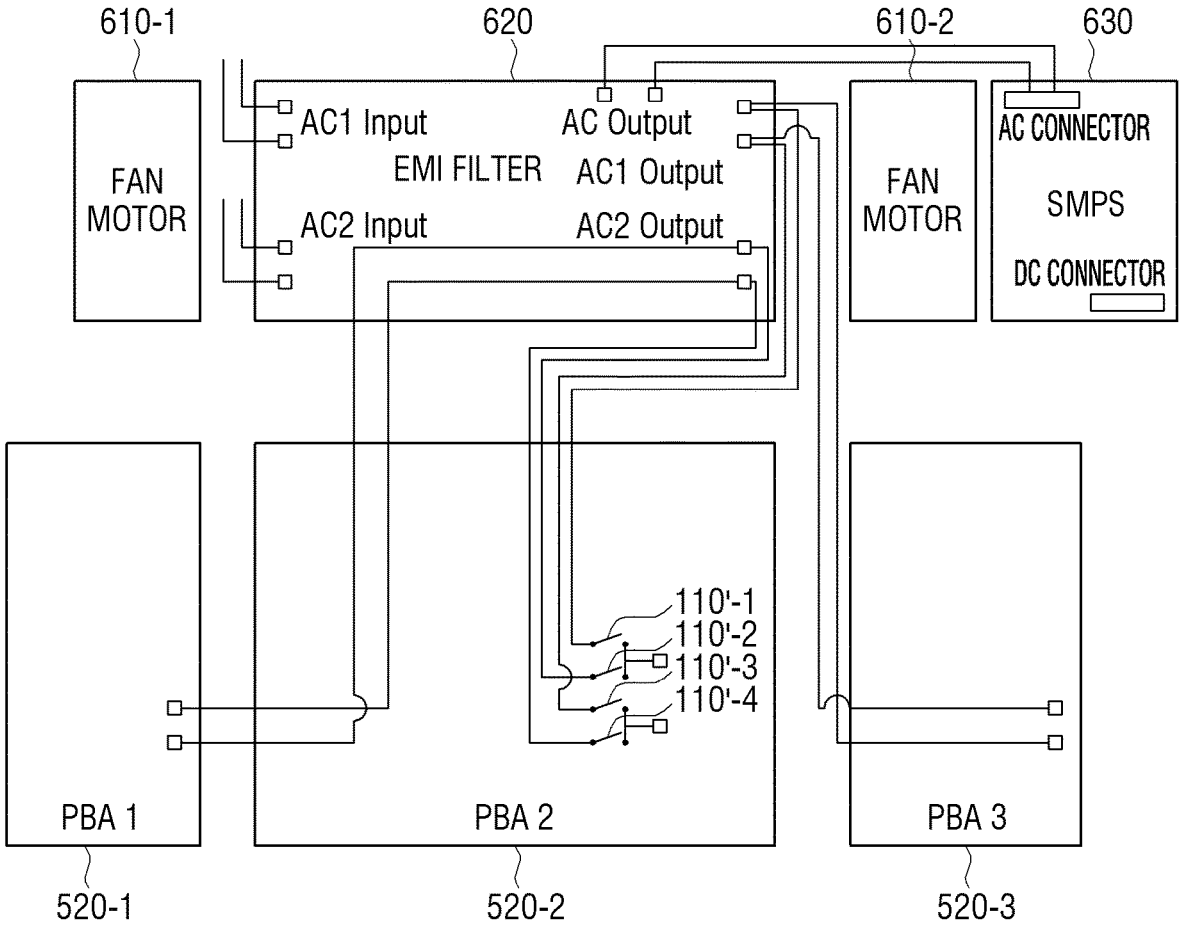
FIG. 6 is another circuit diagram of the example cooking apparatus in FIG. 4 according to an embodiment of the disclosure.

FIG. 6 is another circuit diagram of the example cooking apparatus in FIG. 4 according to an embodiment of the disclosure.

Referring to FIG. 6, a circuit configuration of the cooking apparatus 100' may include a plurality of fan motors 610-1 and 610-2, an electromagnetic interference (EMI) filter 620, a switching mode power supply (SMPS) 630, a plurality of PBAs 520-1, 520-2 and 520-3, and a plurality of switches 110'-1, 110'-2, 110'-3 and 110'-4.

Operations of the plurality of PBAs 520-1, 520-2 and 520-3 and the switching circuit 110' have been described above in connection with the operations of FIG. 5, and thus detailed descriptions thereof are omitted.

The fan motor 610-1 and 610-2 may perform cooling of a heat sink (not illustrated) that is attached to at least one of PBAs 520-1, 520-2 and 520-3.

The SNIPS 630 may convert one of the first power supply or the second power supply into a direct current (DC) power supply.

The EMI filter 620 may include a transformer and a capacitor and may remove noise mixed in a power supplied from the plurality of power supplies 140-1 and 140-2. In addition, the two power supplies 140-1 and 140-2 input to the EMI filter 620 may be connected to supply power to the respective PBAs.

For example, the PBA 1 520-1 may acquire a fixed power from the second power supply 140-2. The PBA 3 may acquire a fixed power from the first power supply 140-1. The PBA 2 may selectively acquire power from the first power supply 140-1 or the second power supply 140-2 via the switching circuit 110'.

In FIG. 6, fan motors 610-1 and 610-2 are included. However, in an example embodiment, a single fan may be included three or more fan motors may be provided.

Referring to FIG. 6, the switching circuit 110' is combined into the PBA 2 520-2. However, the switching circuit 110' may be disposed on a first substrate including the third inverter 530-3 and spaced apart from the PBA 2 520-2.

Figure 7:
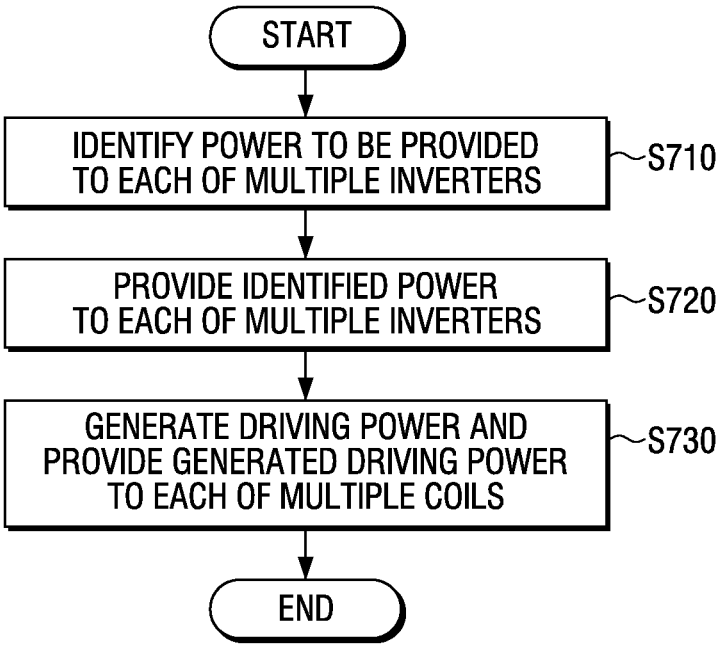
FIG. 7 is a flowchart illustrating a method for controlling of a cooking apparatus according to an embodiment of the disclosure.

FIG. 7 is a flowchart illustrating a method for controlling of a cooking apparatus according to an embodiment of the disclosure.

Referring to FIG. 7, it is presumed that a cooking apparatus acquires input of a plurality of power supplies of different phases.

First, a power supply may be identified to be connected to a plurality of inverters individually providing a driving power to each of a plurality of heating coils at operation S710.

Here, a method for identifying a power supply to be provided to the plurality of inverters may be a method of identifying from among a first power supply or a second power supply based on a power consumption of each of the plurality of heating coils.

For example, when a power consumption of the first heating coil is 3 kW, a power consumption of the second heating coil is 1.2 kW, and a power consumption of the third heating coil is 0.8 kW, it may be identified that the first power supply is connected to the first inverter and that the second power supply is connected to both the second inverter and the third inverter.

In addition, prior to identifying of a power supply to be connected to the plurality of inverters, a command for each of the plurality of heating coils may be acquired, and then, a power supply to be connected to each of the plurality of inverters may be identified so that a driving power may be provided to each of the plurality of heating coils.

For example, a command requires a strong output with respect to the first heating coil, a command requires an intermediate output with respect to the second heating coil, and a command requires a small output with respect to the third heating coil. In this case, it may be identified that the first power supply is connected to the first heating coil, and that the second power supply is connected to both the second heating coil and the third heating coil.

In addition, after a command is input, a method identifies a power supply to be connected to the plurality of inverters, identifies when a use command of the second heating coil is input while the first power supply is provided to the first inverter corresponding to the first heating coil from among the plurality of heating coils, and connects the second power supply to the second inverter corresponding to the second heating coil.

For example, it may be identified that, while the first heating coil performs a heating operation using a power provided from the first power supply, when a turn-on command and a specific output level command for the second heating coil is input, the second power supply, which is not currently providing power, is connected to the second heating coil to supply drive power.

In addition, a method may identify that, while the first power supply is connected to the first inverter corresponding to the first heating coil and the second power supply is connected to the second inverter corresponding to the second heating coil, when a use command of the third heating coil is input, a power supply connected to an inverter corresponding to a heating coil consuming a lower power consumption amount from coil is provided to the third inverter corresponding to the third heating coil.

For example, when a power consumption of the first heating coil is 230 V×13 A=2990 W and a power consumption of the second heating coil is 230 V×3 A=690 W, it may be identified that the second power supply supplies power to the second heating coil, which is consuming less power (690 W) than is provided to the third inverter.

In addition, when a use command of the first heating coil or the second heating coil is changed and a heating coil that is consuming less power changes, the method identify that a power supply connected to an inverter corresponding to the changed heating coil.

For example, when a power consumption of the first heating coil is 230 V×3 A=690 W and a power consumption of the second heating coil is 230 V×13 A=2990 W, but a command with respect to the first heating coil increases the power consumption to 230 V×15 A=3450 W, it may be identified that the second power supply supplies the power to the second heating coil, which is consuming less power (2990 W) than is provided to the third inverter.

In addition, the identified power supply may be provided to each of the plurality of inverters, at operation S720.

In this case, a method for providing a power supply identified when the heating coil consuming less power described above is changed may disconnect a previous power supply from to the third inverter, and then connect a power supply to the third inverter corresponding to the changed heating coil.

For example, the previous power supply may be disconnected from the third inverter, and after a preset time elapses, the power supply may be provided to the third inverter corresponding to the changed heating coil. Here, the preset time may be 15 ms, as described above with reference to FIG. 3.

In addition, a driving power may be generated and provided to each of the plurality of inverters, at operation S730. The respective inverters may provide a driving power necessary to heat the corresponding heating coil.

For example, the first inverter may provide a first driving power supply to the corresponding first heating coil, and the second inverter may provide a second driving power supply to the corresponding second heating coil.

Accordingly, a power consumption amount necessary for the respective heating coils may be identified and a power supply is selectively provided to at least one heating coil by using a switching circuit, so that a cooking function may be improved despite the limited power supply. The method for controlling of FIG. 7 may be performed on the cooking apparatus including the constitution of FIG. 1, 2 or 4, or performed on another cooking apparatus including different constitution.

In addition, the above-described method for controlling may be realized as at least one execution program to execute the above-described controlling method, and such an execution program may be stored in a non-transitory computer readable medium.

A non-transitory computer readable medium may refer to a machine-readable medium or device that stores data semi-permanently and not for a short period of time, such as a register, cache, memory, and the like. Specifically, the above-mentioned various applications or programs may be stored in a non-transitory readable medium such as a compact disc (CD), digital versatile disc (DVD), hard disk, Blu-ray disk, universal serial bus (USB) storage medium, memory card, and a read only memory (ROM) and provided therein.

Figure 8:
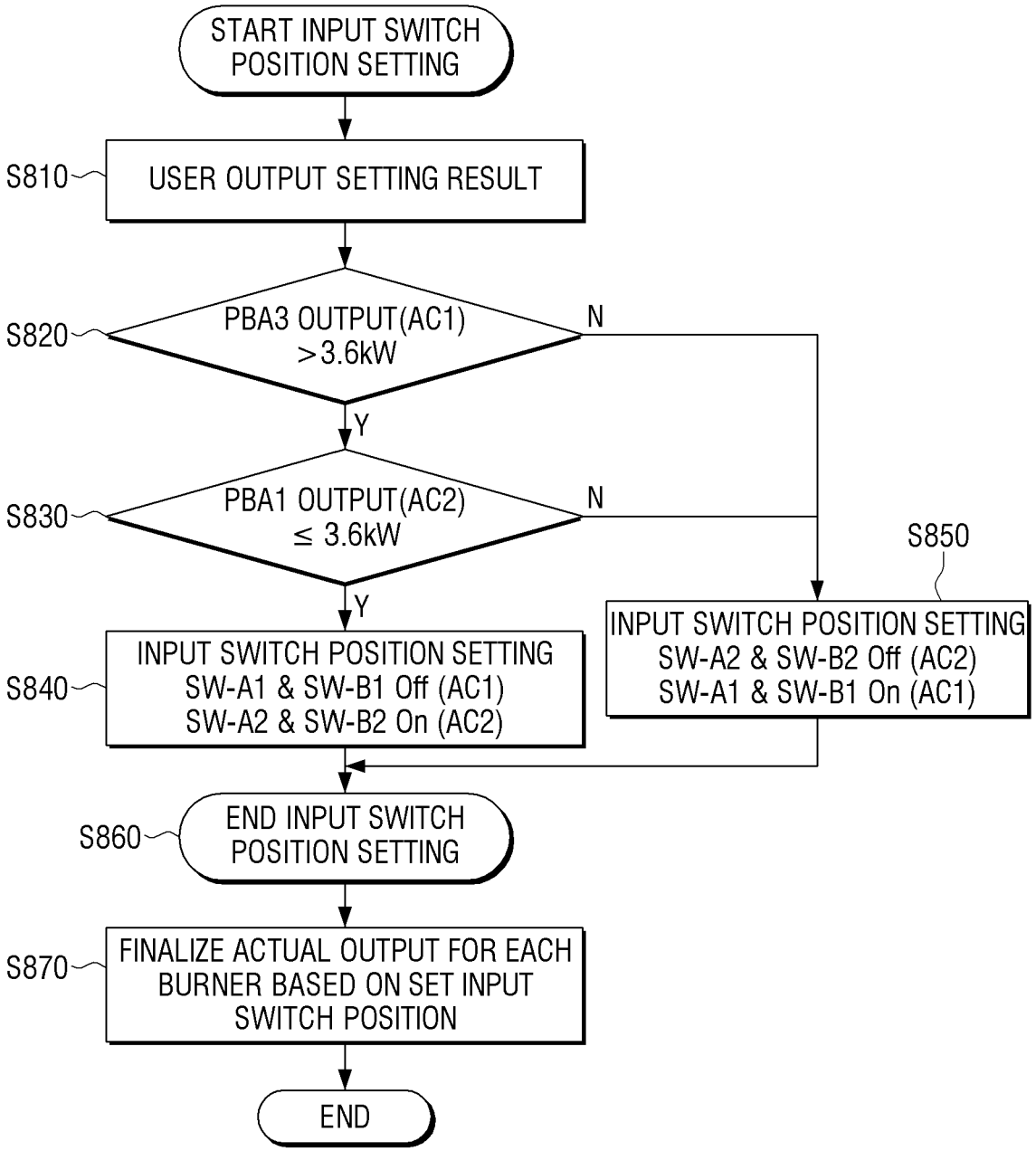
FIG. 8 is a flowchart illustrating a method for identifying a power supply according to an embodiment of the disclosure.

FIG. 8 is a flowchart provided to explain in further detail a power supply identification operation of FIG. 7 according to an embodiment of the disclosure.

Referring to FIG. 8, it may be assumed that an aspect of the method for controlling is a cooking apparatus 100' provided with three PBAs 520-1, 520-2 and 520-3. In addition, FIG. 8 may explain which power supply is to be used when the PBA 2 520-2 is operated while the PBA 1 520-1 and the PBA 3 520-3 are operated. In addition, it may be assumed that the PBA 1 520-1 acquires a fixed power supply from the second power supply 140-2, and that the PBA 3 520-3 acquires a fixed power supply from the first power supply 140-1.

First, a command for each heating coil may be identified at operation S810. A use command such as an output level with respect to the respective heating coils 510-1 to 510-7, and the like may be input from the user via the input apparatus 150.

In addition, it may be identified whether a current output of the first power supply exceeds 3.6 kW, at operation S820. In this case, the PBA 3 520-3 acquires a fixed power supply from the first power supply and thus, when the PBA 2 520-2 is not operated, a power consumption of the PBA 3 520-3 may be calculated as an estimated power of the first power supply.

If a current output of the first power supply does not exceed 3.6 kW at operation S820, a switch position may be set to ON with respect to the switches 110'-1 and 110'-3 connected to the first power supply, and to OFF with respect to the switches 110'-2 and 110'-4 with respect to the second power supply.

Here, 3.6 kW may correspond to identification criteria for selecting a power supply when a power consumption of each of a plurality of power supplies to provide an appropriate power supply from among the plurality of power supplies to a heating coil, and various values other than 3.6 kW may be used as identification criteria according to an implementation method of the cooking apparatus 100'.

For example, when an output of the first power supply is 2.0 kW, power is provided to the PBA 2 520-2 from the first power supply and thus, a switch position may be set to ON with respect to the switches 110'-1 and 110'-3, and to OFF with respect to the switches 110'-2 and 110'-4.

In contrast, when an output of the first power supply exceeds 3.6 kW at operation S820, it may be identified that whether an output of the second power supply exceeds 3.6 kW, at operation S830. In this case, the PBA 1 520-1 acquires a fixed power supply from the second power supply and thus, when the PBA 2 520-2 is not operated, a power consumption of the PBA 1 520-1 may be calculated as an output of the second power supply.

If an output of the second power supply exceeds 3.6 kW at operation S830, a switch position may be set to ON with respect to the switches 110'-1 and 110'-3 connected to the first power supply, and to OFF with respect to the switches 110'-2 and 110'-4 with respect to the second power supply, at operation S850.

For example, when an output of the first power supply is 4.0 kW and an output of the second power supply is 4.0 kW, a power is provided to the PBA 2 520-2 from the first power supply and thus, a switch position may be set to ON with respect to the switches 110'-1 and 110'-3, and to OFF with respect to the switches 110'-2 and 110'-4.

In contrast, when an output of the second power supply does not exceed 3.6 kW at operation S830, a switch position may be set to OFF with respect to the switches 110'-1 and 110'-3, and to ON with respect to the switches 110'-2 and 110'-4, at operation S840.

For example, when an output of the first power supply is 4.0 kW and an output of the second power supply is 2.0 kW, a power is supplied to the PBA 2 520-2 from the second power supply and thus, a switch position may be set to OFF with respect to the switches 110'-1 and 110'-3, and to ON with respect to the switches 110'-2 and 110'-4.

After a switch position is set at operations S840 and S850, a switch position setting may be completed by the switching operation, at operation S860, and an actual output for each burner may be finalized based on the switch position, at operation S870.

Accordingly, in a method for controlling of a cooking apparatus as described herein, a power consumption amount necessary for already-operating heating coils may be identified and a power supply is selectively provided to at least one heating coil by using a switching circuit, so that a cooking function may be improved despite the limited power supply. The method for controlling of FIG. 8 may be performed on the cooking apparatus including the constitution of FIG. 1, 2 or 4, or performed on another cooking apparatus including different constitution.

In addition, the above-described method for controlling may be realized as at least one execution program to execute the above-described controlling method, and such an execution program may be stored in a non-transitory computer readable medium.

The foregoing embodiments and advantages are merely exemplary and are not to be construed as limiting the disclosure. The teaching can be readily applied to other types of apparatuses. Also, the description of the embodiments of the disclosure is intended to be illustrative, and not to limit the scope of the claims, and many alternatives, modifications, and variations will be apparent to those skilled in the art.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cooking apparatus acquiring input of a plurality of power supplies of different phases, the cooking apparatus comprising:

a processor;

a plurality of power supplies including a first power supply and a second power supply;

a plurality of heating coils including a first heating coil and a second heating coil;

an inputter configured to receive a first command for operation of the first heating coil and a second command for operation of the second heating coil;

a plurality of inverters including a first inverter and a second inverter being connected to the first heating coil and the second heating coil, respectively; and a switching circuit configured to selectively provide power from among the first power supply or the second power supply to at least one of the first inverter or the second inverter, wherein the processor is configured to:

control the plurality of inverters to output a first driving power to the first heating coil based on the first command and output a second driving power to the second heating coil based on the second command, wherein the processor is further configured to:

control the switching circuit to connect the first power supply to the first inverter, an output of the first inverter being connected to the first heating coil, in response to receiving a third command of a third heating coil while the second power supply is connected to the second inverter, identify that the first inverter is consuming less power than the second inverter, and control the switching circuit to connect the first power supply to a third inverter, and wherein an output of the third inverter is connected to the third heating coil.

2. The cooking apparatus of claim 1, wherein the processor is further configured to:

based on a first power consumption of the first heating coil and a second power consumption of the second heating coil, identify that at least one of the first power supply or the second power supply is provided to the first inverter or the second inverter.

3. The cooking apparatus of claim 1, wherein the processor is further configured to:

based on the second command of the second heating coil being received while the first power supply is connected to the first inverter, control the switching circuit to connect the second power supply to the second inverter, and wherein an output of the second inverter is connected to the second heating coil.

4. The cooking apparatus of claim 1, wherein the processor is further configured to:

receive a command to change power consumed by the first heating coil or the second heating coil, identify that the first inverter is consuming more power than the second heating coil, and control the switching circuit to connect the second power supply to the third inverter.

5. The cooking apparatus of claim 4, wherein the processor is further configured to:

based on the identifying that the first inverter is consuming more power than the second heating coil, control the switching circuit to disconnect a previous power supply from the third inverter.

6. The cooking apparatus of claim 5, wherein the processor is further configured to:

after a preset time elapses, control the switching circuit to connect a power supply provided to an inverter corresponding to the power changed heating coil.

7. The cooking apparatus of claim 1, wherein the first inverter is configured to provide driving power to the first heating coil based on only the first power supply, wherein the second inverter is configured to provide driving power to the second heating coil based on only the second power supply, wherein the plurality of inverters further comprise a third inverter configured to provide a third driving power to a third heating coil based on the first power supply or the second power supply, and wherein the switching circuit is further configured to selectively connect the first power supply or the second power supply to the third inverter.

8. The cooking apparatus of claim 7, wherein the switching circuit comprises:

a first switch configured to connect an output terminal of the first power supply or an output terminal of the second power supply to an input terminal of the third inverter; and a second switch configured to connect another output terminal of the first power supply or another output terminal of the second power supply to another input terminal of the third inverter.

9. The cooking apparatus of claim 1, wherein each of the plurality of inverters comprises:

a bridge diode circuit configured to rectify input power;

a circuit configured to convert the rectified input power into a direct current (DC) power; and an inverter circuit configured to provide a driving power supply having a preset frequency based on the DC power.

10. The cooking apparatus of claim 1, further comprising:

a plurality of first substrates, each of the plurality of inverters being disposed on the plurality of first substrates, respectively; and a second substrate spaced apart from the plurality of first substrates and including the switching circuit disposed thereon.

* * * * *